United States Patent [19]

Renner

[11] Patent Number: 4,868,099

[45] Date of Patent: Sep. 19, 1989

[54] COLOR PHOTOGRAPHIC RECORDING MATERIAL WITH THIOSULPHONIC ACID ESTER

[75] Inventor: Günter Renner, Bergisch Gladbach, Fed. Rep. of Germany

[73] Assignee: Agfa-Gevaert Aktiengesellschaft, Leverkusen, Fed. Rep. of Germany

[21] Appl. No.: 244,051

[22] Filed: Sep. 14, 1988

[30] Foreign Application Priority Data

Sep. 26, 1987 [DE] Fed. Rep. of Germany ..... 3732512

[51] Int. Cl.[4] ..... G03C 7/38

[52] U.S. Cl. ..... 430/546; 430/543; 430/550; 430/554

[58] Field of Search ..... 430/554, 555, 550, 543, 430/546

[56] References Cited

U.S. PATENT DOCUMENTS 3,930,866 1/1976 Oishi et al. ..... 430/555

4,032,346 6/1977 Furutachi et al. ..... 430/555

*Primary Examiner*—Richard L. Schilling

*Attorney, Agent, or Firm*—Connelly & Hutz

[57] ABSTRACT

A color photographic recording material having a magenta layer which is prepared from a casting solution containing a 4-equivalent magenta coupler of the pyrazolone series and a thiosulphonic acid ester compound has the properties of 2-equivalent magenta couplers in its coupling reactivity and the properties of 4-equivalent magenta couplers in its speed of color formation.

5 Claims, No Drawings

COLOR PHOTOGRAPHIC RECORDING MATERIAL WITH THIOSULPHONIC ACID ESTER

This invention relates to a colour photographic recording material containing at least one silver halide emulsion layer and at least one layer associated with a magenta coupler of the pyrazolone series.

The magenta couplers used, i.e. colour couplers suitable for producing the magenta colour image, are generally compounds derived from pyrazolone-5. Commonly used magenta couplers are, for example, those pyrazolone-5 compounds which are substituted with an acyl amino group in the 3-position. 3-anilinopyrazolone-5 couplers are distinguished from the aforesaid couplers by their low side densities both in the red and in the blue spectral region, by their stability in the heat and under tropical conditions and when stored in a storage cupboard and by the excellent stability to light of azomethine dyes obtained by their reaction with p-phenylene diamines as well as by their high reactivity and coupling activity.

2-equivalent magenta couplers of the pyrazolone series containing a substituent which has been introduced in the coupling position and is split off as fugitive group in the process of colour development have been used for improving the efficiency of colour formation. Colours of this type are described, for example, in US-A-3 311 476, 3 419 391, 3 617 291 and 3 926 631 and in DE-A 25 36 191, 26 51 363 and 27 03 589. Other magenta couplers, in which a substituent, in particular an aryl group, is attached in the coupling position by a sulphur atom are described in US-A 3 214 437, 4 032 346, 3 227 554, 3 701 783 and 4 383 027, in EP-A 0 081 768, in JA 34044/78 and in DE-A 29 44 601 and 33 18 759.

Such 2-equivalent couplers couple at a sufficiently high colour formation rate under normal operating conditions so that there is an advantageous saving in silver and coupler. Various methods of synthesis are known for the preparation of such 2-equivalent magenta couplers. According to one of these methods, for example, a suitable thiophenol is converted into sulphinic acid chloride and reacted with a sulphinic acid, in particular an aromatic sulphinic acid. The resulting thiosulphonic acid ester may then be reacted with the 4-equivalent magenta coupler in an alcoholic, alkaline medium to form the required 2-equivalent coupler (DE-A-3 241 886). Although this method produces good results, it is unsatisfactory in that the resulting 2-equivalent magenta couplers can barely be obtained in yields greater than 60% after recrystallization to a degree of purity sufficient for photographic requirements.

This greatly increases the prices of such couplers. These compounds (2-equivalent magenta couplers) nevertheless have considerable advantages, namely they couple with a steep gradation, which improves the brilliancy of the images;

they couple with a high colour yield, which allows a smaller quantity of silver to be applied; and they are resistant to damaging gases when stored both under moist, warm conditions and in the light, as manifested by the distinctly reduced degree of yellowing of the image white.

Extensive investigations have now shown, however, that the speed of the colour formation reaction, which in the case of 2-equivalent couplers is produced by the addition of oxidized colour developer and elimination of a fugitive group, is distinctly less than that obtained with 4-equivalent couplers, in which the addition of oxidized colour developer is followed by (a further) oxidation reaction. When short processing times are used, this has the undesirable effect when 2-equivalent magenta couplers are used that although the full colour density can be obtained some time after processing, the formation of colour is still incomplete immediately after processing, so that it is extremely difficult to assess the formation of colour. The delay in dye formation may extend over several weeks, depending on the storage conditions.

It is an object of the present invention to provide a colour photographic recording material with which colour images of high colour density can be obtained immediately after processing even when the processing time is reduced, and the colour balance undergoes no significant change after processing has finished. At the same time, the recording material should have all the advantages of 2-equivalent magenta couplers and the magenta couplers should be readily accessible.

This invention relates to a colour photographic recording material containing at least one light sensitive silver halide emulsion layer with which a magenta coupler of the pyrazolone series is associated, characterised in that the layer containing the magenta coupler has been prepared from a casting solution containing a 4-equivalent magenta coupler corresponding to the following formula I

I

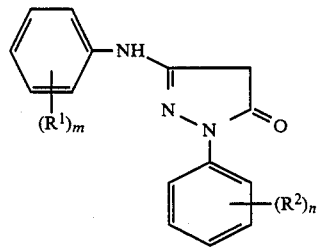

wherein n has the value 1 to 5, m has the value 1 to 3, $R^1$ denotes halogen, alkoxy, alkylthio, acyl amino, carbamoyl, sulphonamido, sulphamoyl or alkoxycarbonyl and $R^2$ denotes halogen, cyano, thiocyanato, alkoxy, alkyl, acyl amino, carbamoyl, sulphonylamido, sulphomoyl or alkoxycarbonyl, as well as a thiosulphonic acid ester compound.

Examples of 4-equivalent magenta couplers corresponding to formula I are given below:

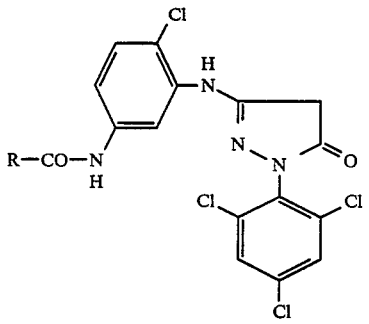
R = $C_{13}H_{27}$ I-1
R = $C_{15}H_{31}$ I-2
I-3
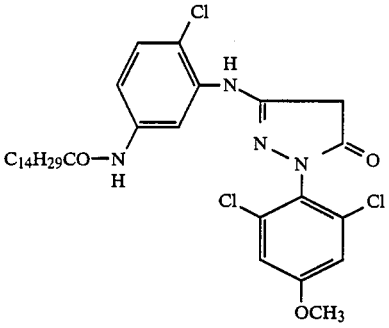
I-4
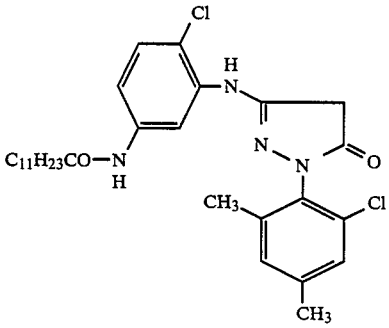
I-5
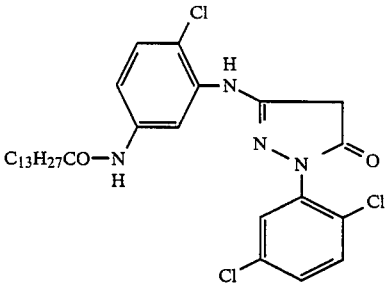
I-6
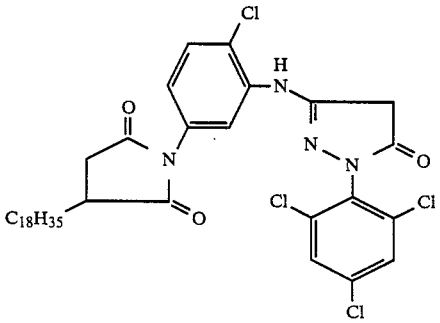

-continued
I-7
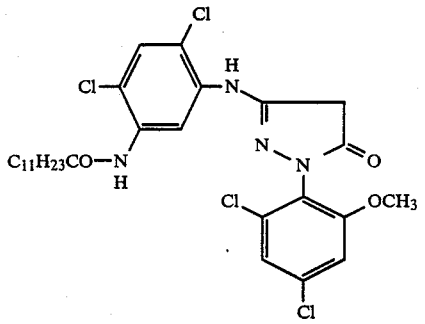
I-8
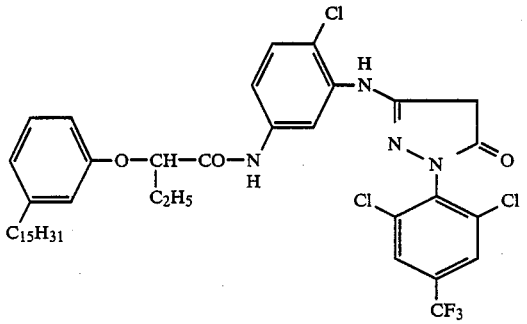
I-9
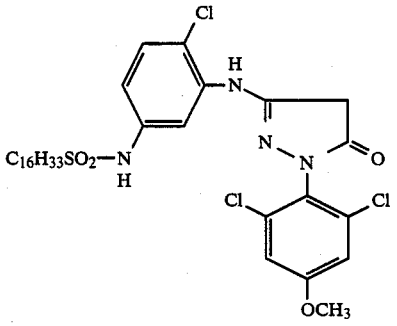
I-10
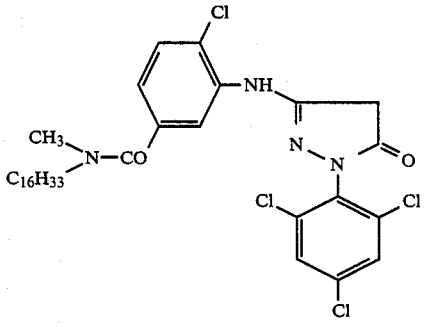
I-11
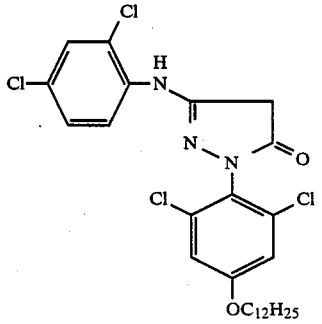

-continued
I-12
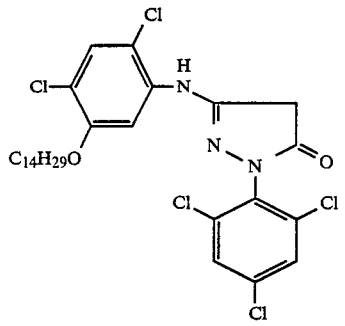
I-13
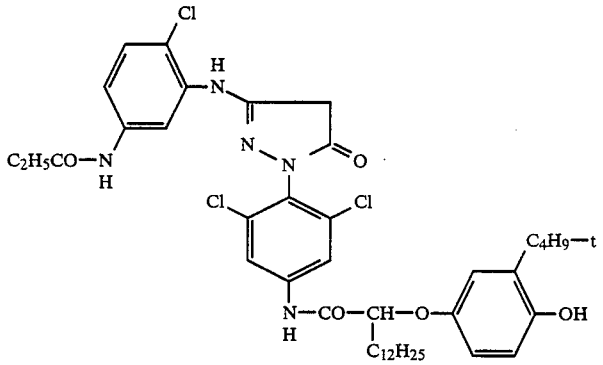
I-14
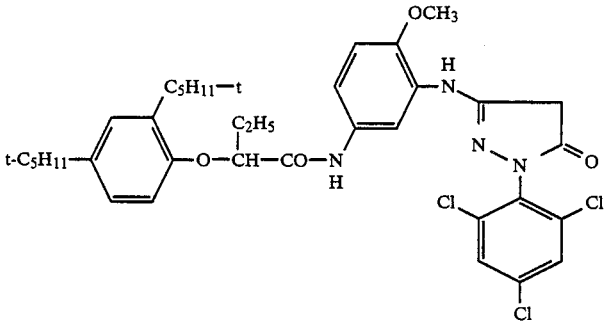
I-15
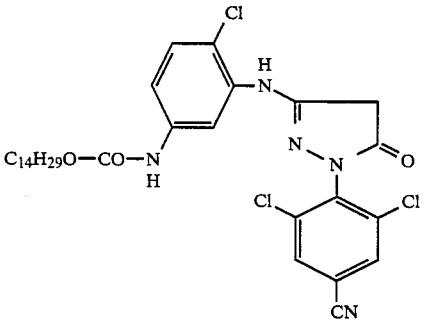
I-16
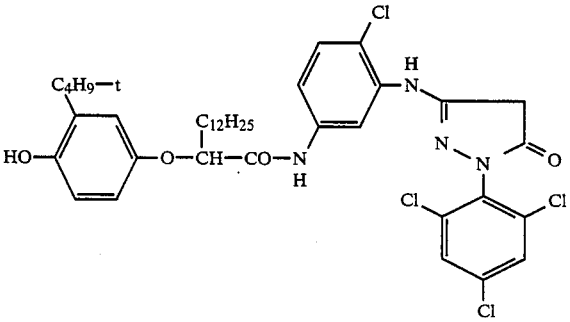

-continued
I-17
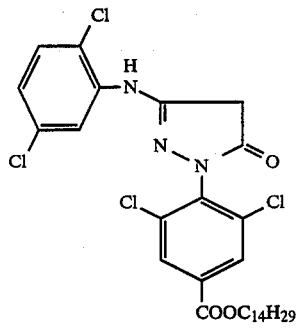
I-18
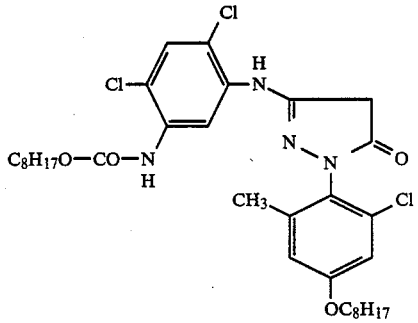
I-19
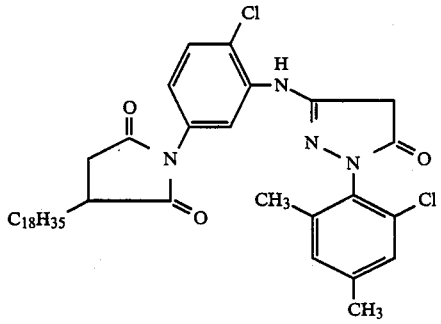
I-20
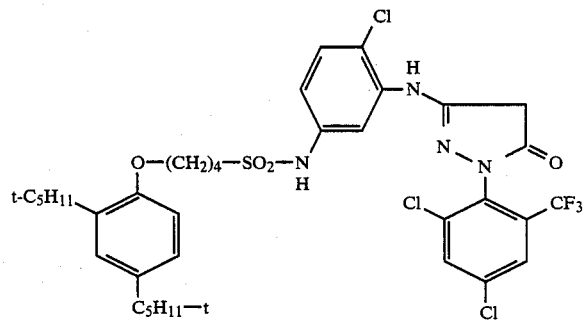
I-21
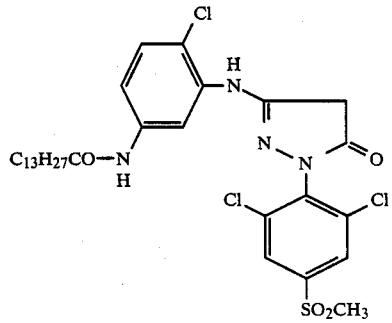

-continued

I-22

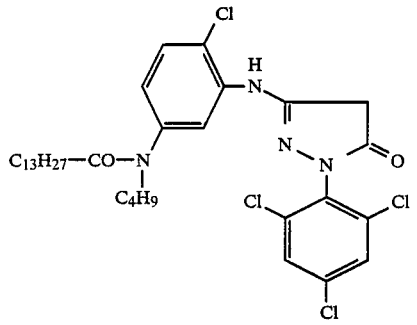

The thiosulphonic acid ester compound used according to the invention preferably corresponds to the following formula II $$R^3—SO_2—S—R^4$$

wherein $R^3$ and $R^4$ denote, independently of one another, an alkyl, aralkyl, aryl or heterocyclic group.

An alkyl group denoted by $R^3$ or $R^4$ may, for example, contain up to 20 carbon atoms and may be straight chained or branched. It may also be substituted, e.g. by halogen, amino, alkoxycarbonyl, alkylsulphonyl, aryl or a heterocyclic group.

An arayl group denoted by $R^3$ and $R^4$ may be, for example, a phenyl group which may be substituted, e.g. by halogen, alkyl, alkoxy, aroxy, alkylthio, amino, acyl amino, sulphonamide, carbamoyl, sulphamoyl or a heterocyclic group.

A heterocyclic group may be, for example, one of the following: quinolyl, pyrazolyl, tetrazolyl, triazolyl, imidazolyl, benzimidazolyl, tetrahydrofuryl and pyridyl, and such heterocyclic groups may be substituted, e.g. by halogen, alkyl, alkoxy, alkylthio, acylamino or aryl.

A list of suitable groups $R^3$ (sulphonic acid components) is given below:

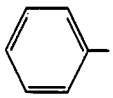

S-1

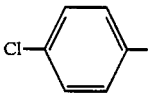

S-2

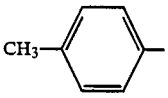

S-3

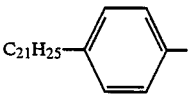

S-4

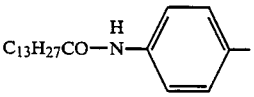

S-5

-continued

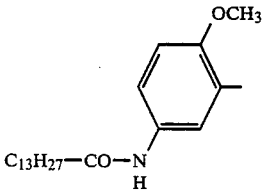

S-6

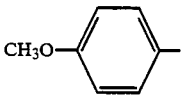

S-7

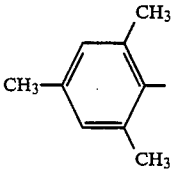

S-8

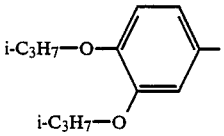

S-9

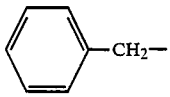

S-10

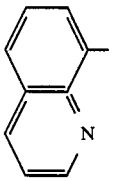

S-11

$C_{16}H_{33}$— S-12

$C_8F_{17}$— S-13

$C_4F_9$— S-14

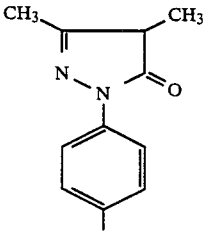

S-15

-continued
S-16
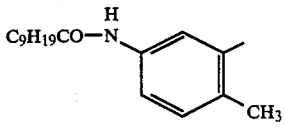
S-17
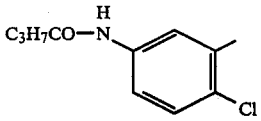
S-18
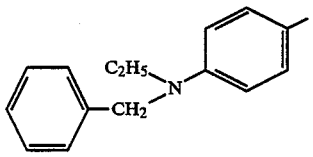
S-19
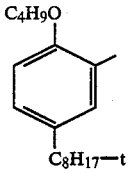
S-20
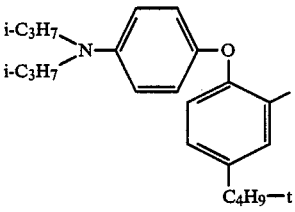
S-21
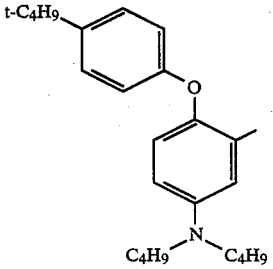
S-22
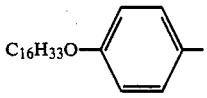
S-23
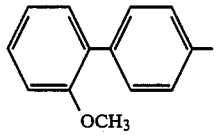
S-24
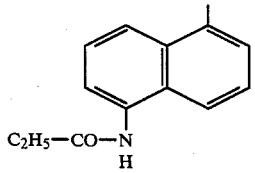
-continued
S-25
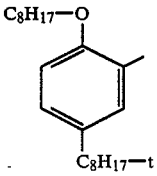
S-26
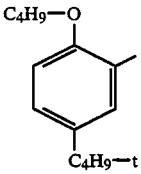
S-27
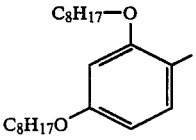
S-28
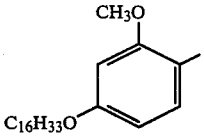
S-29
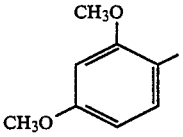
S-30
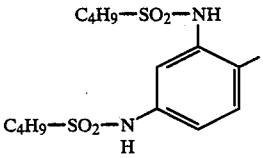
S-31
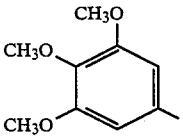
S-32
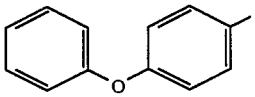
S-33
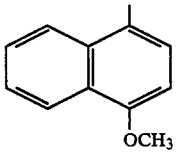
S-34
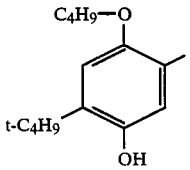

-continued
S-35
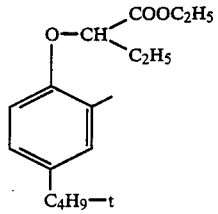
S-36
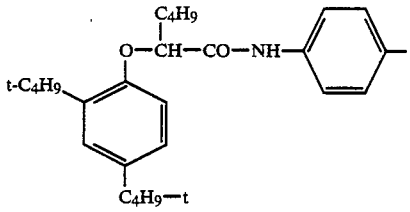
S-37
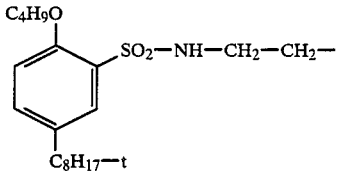
S-38
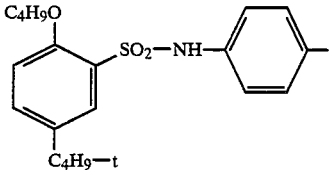
A list of suitable groups $R^4$ (thiol components) is given below:
T-1
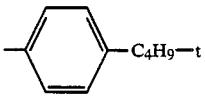
T-2
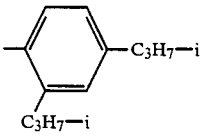
T-3
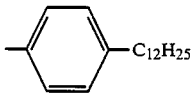
T-4
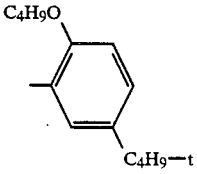
-continued
T-5
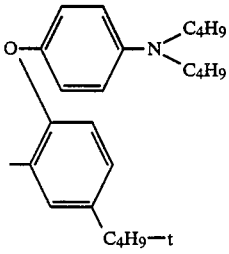
T-6
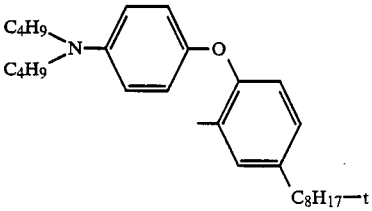
T-7
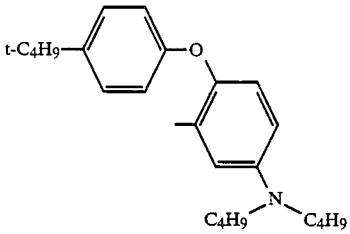
T-8
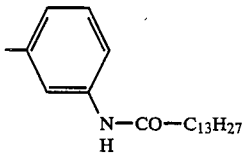
T-9
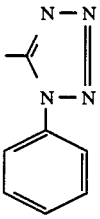
T-10
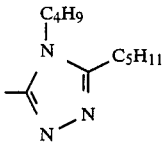
T-11
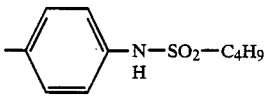
T-12
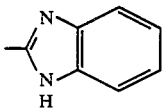
T-13
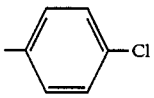

-continued
T-14
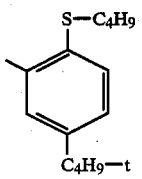
T-15
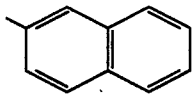
T-16
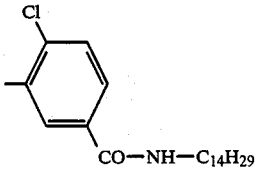
T-17
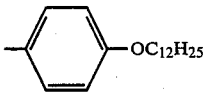
T-18
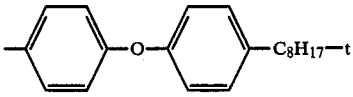
T-19
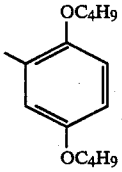
T-20
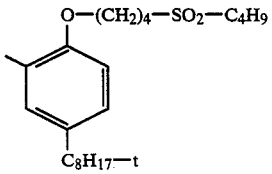
T-21
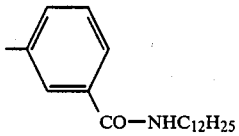
T-22 —$C_{12}H_{25}$
T-23 —$C_{16}H_{33}$
T-24
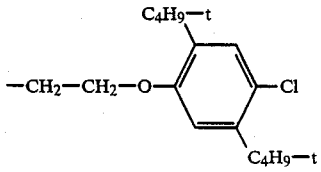
T-25
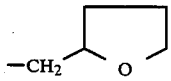
-continued
T-26
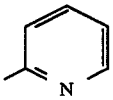
T-27
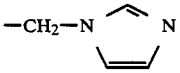
T-28
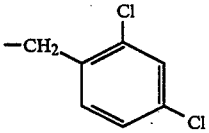
T-29
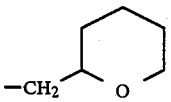
T-30
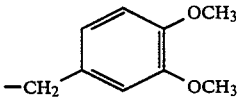
T-31
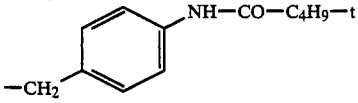
T-32 —$CH_2$—$COOC_4H_9$
T-33 —$CH_2$—$CH_2$—$SO_2$—$C_2H_5$
T-34
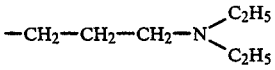
The following are given as examples of thiosulphonic acid esters of formula II used according to the invention:
| | $R^3$—$SO_2$—S—$R^4$ | |
|---|---|---|
| II | $R^3$ | $R^4$ |
| 1 | S-1 | T-1 |
| 2 | S-1 | T-8 |
| 3 | S-2 | T-2 |
| 4 | S-2 | T-9 |
| 5 | S-2 | T-22 |
| 6 | S-3 | T-1 |
| 7 | S-3 | T-2 |
| 8 | S-3 | T-4 |
| 9 | S-3 | T-5 |
| 10 | S-3 | T-7 |
| 11 | S-3 | T-14 |
| 12 | S-12 | T-22 |
| 13 | S-3 | T-23 |
| 14 | S-3 | T-24 |
| 15 | S-4 | T-3 |
| 16 | S-4 | T-15 |
| 17 | S-4 | T-18 |
| 18 | S-5 | T-2 |
| 19 | S-5 | T-6 |
| 20 | S-5 | T-13 |
| 21 | S-6 | T-2 |
| 22 | S-6 | T-4 |
| 23 | S-6 | T-21 |
| 24 | S-7 | T-6 |
| 25 | S-7 | T-20 |
| 26 | S-8 | T-1 |
| 27 | S-9 | T-2 |
| 28 | S-9 | T-10 |
| 29 | S-9 | T-19 |

-continued

| II | $R^3$—$SO_2$—S—$R^4$ $R^3$ | $R^4$ |
|---|---|---|
| 30 | S-10 | T-6 |
| 31 | S-11 | T-22 |
| 32 | S-12 | T-11 |
| 33 | S-12 | T-19 |
| 34 | S-13 | T-5 |
| 35 | S-13 | T-12 |
| 36 | S-13 | T-16 |
| 37 | S-14 | T-2 |
| 38 | S-15 | T-2 |
| 39 | S-16 | T-4 |
| 40 | S-17 | T-2 |
| 41 | S-17 | T-22 |
| 42 | S-18 | T-17 |
| 43 | S-19 | T-1 |
| 44 | S-19 | T-6 |
| 45 | S-19 | T-9 |
| 46 | S-20 | T-6 |
| 47 | S-20 | T-24 |
| 48 | S-21 | T-2 |
| 49 | S-21 | T-5 |
| 50 | S-21 | T-11 |
| 51 | S-21 | T-14 |

The compounds corresponding to formula II are known and may be synthesised by methods such as those described in Houben Weyl, Methoden der Organischen Chemie, volume E11, page 1113 et sec. Processes in which sulphinic acids or their salts are reacted with sulphenic acid halides are preferred. Compounds corresponding to formula II are also described in DE-A-32 41 886.

Synthesis of compound II-7

388 g of 2,4-diisopropylthiophenol are dissolved in 1,500 ml of dichloromethane, and 161 ml of sulphuryl chloride are slowly added at room temperature. The mixture is then stirred for 30 minutes and the acid gases and the solvents are distilled off. The residue is slowly introduced at room temperature into a suspension of 365 g of the sodium salt of p-toluene sulphinic acid in dichloromethane. After the reaction has been completed, the product is poured out on water, separated, washed and dried. It may then be recrystallized from methanol after evaporation of the solvent.

Yield: 585 g (84% of theoretical) m.p. 74° C.

Synthesis of compound II-12

(a) Cetyl sulphinic acid 200 g of cetyl sulphonic acid chloride are introduced at room temperature into 87 ml of hydrazine hydrate in 600 ml of methanol. The sulphonic acid hydrazide precipitates and may be separated by suction filtration. The residue is then introduced into a solution of 48 g of NaOH in 1,500 ml of water and 1,000 ml of methanol and slowly heated to boiling with stirring. The solvent is slowly distilled off and the temperature is maintained at 90° to 95° C. for about 4 hours. The sodium salt of cetyl sulphinic acid is separated by suction filtration after cooling. The compound is dried.

Yield: 170 g (91% of theoretical).

(b) Cetyl thiosulphonic acid dodecyl ester 36 g of dodecane thiol are converted into the corresponding sulphenic acid chloride by reaction with sulphuryl chloride as described above. This compound is added to a suspension of 56 g of the compound obtainable under (a). The mixture is then stirred for 2 hours and concentrated by evaporation and the residue is recrystallized from ethanol. m.p. 56° to 57° C.

Yield: 77 g (87% of theoretical).

4-equivalent magenta coupler (I) and thiosulphonic acid ester (II) are together added to the casting solution for the magenta layer and the solution is cast and dried. The coupler (I) and thiosulphonic acid ester (II) are generally used in a molar ratio of from 0.25:1 to 2.0:1, preferably from 0.7:1 to 1.2:1 and most preferably in approximately equimolar quantities.

Photographic recording materials containing a magenta layer as prepared above have sensitometric properties such as colour yield and gradation and properties of stability such as would be expected from using 2-equivalent magenta couplers. It is surprisingly found, however, that these recording materials do not have the disadvantage which is characteristic of 2-equivalent magenta couplers of delayed dye formation with the attendant disadvantage of subsequent change in the gradation. In this respect, the recording materials containing the magenta layers according to the invention behave as if they contained unmodified 4-equivalent magenta couplers. This finding, especially the high coupling activity which is an indication of the presence of 2-equivalent magenta couplers, is surprising since comparison experiments have shown that mixtures of compounds of formulae I and II are completely stable in vitro, i.e. before the formation of thin layers, under the conditions existing in photographic recording materials (presence of oil formers, optionally auxiliary solvents, wetting agents, gelatine, silver halide and hardeners).

This could be demonstrated by a series of experiments, first at room temperature and then at 55° C. In all cases, the same compound of formula I and the same compound of formula II were mixed together and dissolved (a) in dibutyl phthalate and ethyl acetate
(b) in tricresyl phosphate and ethyl acetate
(c) as in (a) but with the addition of solid gelatine
(d) as in (b) but with the addition of solid gelatine
(e) as in (a) but with the addition of 5% aqueous gelatine and a wetting agent
(f) as in (b) but with the addition of 5% aqueous gelatine and a wetting agent
(g) as in (e) but with the addition of an instant hardener, e.g. CAS Reg. No. 65 411-60-1 and
(h) as in (f) and with the addition of instant hardener.

In addition, emulsions of the two compounds I and II together were prepared and casting solutions were prepared by the addition thereto of silver halide emulsions.

The samples listed above were suitably worked up and investigated by thin layer chromatography. It was found that virtually no 2-equivalent coupler (at most 10%) is formed in any of the experiments, i.e. that the formation of the compound aimed at is impossible under these conditions. This confirms the surprising effect that a reaction between compounds of formulae I and II only takes place in the photographic material (possibly owing to the smaller distances in the dried form).

In the process of preparation of the light sensitive colour photographic recording material according to the present invention, the 4-equivalent magenta couplers (I) and the compounds of formula II are incorporated in a casting solution for a silver halide emulsion layer or another colloid layer in known manner, if necessary with the aid of suitable oil formers. The 4-equivalent magenta couplers and the thiosulphonic acid esters may be added to a hydrophilic colloid solution from separate solutions or from a common solution in a suitable coupler solvent (oil former) optionally in the presence of a wetting agent or dispersing agent.

The oil formers used are substances which generally have boiling points above 180° C. and readily dissolve the substances to be dispersed. The oil formers preferably used are esters of glutaric acid, adipic acid, phthalic acid, sebacic acid, succinnic acid, maleic acid, fumaric acid, isophthalic acid, terephthalic acid or phosphoric acid or the esters of glycerol or paraffin or fluorinated paraffin because these compounds are chemically resistant and very readily available and easy to handle and when the dispersions are used for photographic purposes they have no deleterious effect on the light sensitive materials. The following are examples of frequently used oil formers: tricresyl phosphate, triphenyl phosphate, dibutyl phthalate, di-n-octyl phthalate, di-2-ethylhexyl phthalate, glycerol tributyrate, glycerol tripropionate, dioctyl sebacate, paraffin and fluorinated paraffin. Mono esters of fatted succinnic acids have also been shown to be advantageous. Compounds of this kind are described in US-A-3 689 271. Carboxylic acid dialkylamides such as diethyl lauramide, palmitic acid diethylamide and phthalic acid dialkylamides are also suitable oil formers.

The compounds corresponding to formula II and the sulphinic acids possibly formed from them occasionally have oil forming properties and have and advantageous effect on the stability of the coupler dispersion contained in the dried layer. In addition, the presence of the sulphinic acids formed may be advantageous owing to their action as anti-oxidants. Since they are generally not photographically inert (under certain conditions they may, for example, reduce cyan indoaniline dyes to the leuco dyes) it is sometimes advantageous to choose a compound of formula II which has been obtained from a diffusion resistant sulphinic acid, e.g. a sulphinic acid containing at least 16 carbon atoms.

The hydrophilic casting solution may, of course, contain conventional additives in addition to the binder. The solution of coupler and thiosulphonic acid ester need not be directly dispersed in the casting solution for the silver halide emulsion layer or another water permeable layer but may advantageously first be dispersed in an aqueous, light insensitive solution of a hydrophilic colloid and the resulting mixture may then be mixed with the casting solution for the light sensitive silver halide emulsion layer or another water permeable layer, optionally after removal of the low boiling organic solvent used, before the casting solution is applied to form a layer.

The halides of the light sensitive silver halide emulsions used in the light sensitive layers may be chloride, bromide, iodide or mixtures thereof. Emulsions having a high chloride content and containing less than 1 mol% of bromide are preferred.

The emulsions may be heterodisperse or monodisperse emulsions, preferably with an average particle size of from 0.3 μm to 1.2 μm. The silver halide grains may have a layered grain structure.

The emulsions may be chemically and spectrally sensitized in the usual manner and they may be stabilized with suitable additives. Suitable chemical sensitizers, spectral sensitizing dyes and stabilizers are described, for example, in Research Disclosure 17643 (December 1978); see in particular chapters III, IV and IV.

The colour photographic recording material according to the invention preferably contains at least one silver halide emulsion layer for each of the three spectral regions, red, green and blue, which layers are spectrally sensitized in known manner with suitable sensitizing dyes for recording light from the appropriate spectral region.

Layers which differ in their spectral sensitivity are generally separated by a light insensitive interlayer which may contain substances for preventing accidental diffusion of developer oxidation products. If a material contains several silver halide emulsion layers of the same spectral sensitivity, these may be arranged directly adjacent to one another or they may be separated by a light sensitive layer of a different spectral sensitivity (DE-A-19 58 709, DE-A-25 30 645, DE-A-26 22 922).

Colour photographic recording materials according to the invention normally contain colour couplers for producing the different partial colour images in cyan, magenta and yellow in spatial and spectral association with the silver halide emulsion layers of the different spectral sensitivities, the magenta couplers being generally associated with a green sensitive silver halide emulsion layer.

The term "spatial association" is understood to mean that the colour coupler is situated in such a spatial relationship to the silver halide emulsion layer that the two are capable of interacting to result in an imagewise correspondence between the silver image formed as a result of development and the colour image produced from the colour coupler. This is generally achieved by providing the colour coupler in the silver halide emulsion layer itself or in an adjacent layer of binder which is optionally insensitive to light.

By "spectral association" is meant that the spectral sensitivity of each of the light sensitive silver halide emulsion layers and the colour of the partial colour image produced from the respective spatially associated colour coupler are in a certain relationship to one another, each of the spectral sensitivities (red, green, blue) having a different colour of the partial colour associated therewith (generally e.g. the colours cyan, magenta and yellow, in that order).

In preferred embodiments, therefore, red sensitive silver halide emulsion layers have at least one non-diffusible colour coupler associated with them for the production of the cyan partial colour image, generally a coupler of the phenol or α-naphthol series. Green sensitive silver halide emulsion layers have at least one non-diffusable colour coupler associated with them for production of the magenta partial colour image. According to the invention, this colour coupler is a 4-equivalent magenta coupler which has been incorporated in the layer together with a thiosulphonic acid ester in addition to the 2-equivalent coupler used according to the invention.

Blue sensitive silver halide emulsion layers have at least one non-diffusable colour coupler associated with them for the production of the yellow partial colour image, generally a colour coupler containing an open chain ketomethylene group. Colour couplers of this type are known in large number and have been described in numerous patent specifications and other publications, for example the publication "Farbkuppler" by W. Pelz in "Mitteilungen aus den Forschungslaboratorien der Agfa, Leverkusen/Munchen", volume III, page 111 (1961) and a publication by K. Venkataraman in "The Chemistry of Synthetic Dyes", volume 4, 341 to 387, Academic Press (1971).

The usual layer supports are suitable for the recording materials used according to the invention, e.g. supports of cellulose esters such as cellulose acetate and of polyesters. Paper supports are also suitable and may be coated, e.g. with polyolefines, in particular with polyethylene or polypropylene; see Research Disclosure 17643, chapter XVII.

The protective colloids or binders used for the layers of the recording material may suitably be any of the conventional hydrophilic film forming substances, e.g. proteins, in particular gelatine. Casting auxiliaries and plasticizers may also be used; see Research Disclosure 17643, chapters IX, XI and XII.

The layers of the photographic material may be hardened in the usual manner, for example with hardeners containing at least two reactive oxirane, aziridine or acryloyl groups. The layers may also be hardened by the process described in DE-A-22 18 009. Furthermore, the photographic layers or colour photographic multilayered materials may be hardened with hardeners of the diazine, triazine or 1,2-dihydroquinoline series or with vinyl sulphone type hardeners. Other suitable hardeners are disclosed in DE-A-24 39 551, DE-A-22 25 230 and DE-A-24 39 551 and in Research Disclosure 17643, chapter X. The stabilizing effect of the oil formers according to the invention is particularly pronounced when hardeners which activate carboxyl groups are used, e.g. carbamoyl pyridinium salts or carbamoyl oxypyridinium salts.

Other suitable additives are mentioned in Research Disclosure 17643 and in "Product Licensing Index" of December 1971, pages 107 to 110.

Suitable colour developer substances for the material according to the invention include in particular those of the p-phenylene diamine series, e.g. 4-amino-N,N-diethylaniline-hydrochloride, 4-amino-3-methyl-N-ethyl-N-β-(methanesulphonamido)-ethylaniline sulphate hydrate, 4-amino-3-methyl-N-methyl-N-β-hydroxyethylaniline sulphate, 4-amino-N-ethyl-N-(2-methoxyethyl)-m-toluidine-di-p-toluene sulphonic acid and N-ethyl-N-β-hydroxyethyl-p-phenylene diamine. Other suitable colour developers are described, for example, in J. American Chem. Soc. 73, 3100 (1951) and in G. Haist, Modern Photographic Processing, 1979, John Wiley and Sons, New York, pages 545 et sec.

After colour development, the material is bleached and fixed in the usual manner. Bleaching and fixing may be carried out separately or together. The usual bleaching compound may be used, e.g. $Fe^{3+}$ salts and $Fe^{3+}$ complex salts such as ferricyanides, dichromates, water soluble cobalt complexes, etc.. Iron-III complexes of amino polycarboxylic acids are especially preferred, in particular e.g. ethylene diaminotetra-acetic acid, nitrilotriacetic acid, iminodiacetic acid, N-hydroxyethyl ethylenediaminotriacetic acid and alkylimino dicarboxylic acids and the complexes of the corresponding phosphonic acids. Persulphates are also suitable bleaching agents.

EXAMPLE 1

Colour photographic recording materials were prepared and processed as described below.

(a) Preparation of the colour coupler dispersions.

8 mmol of colour coupler and optionally 8 mmol of aryl or alkylthiosulphonic ester as shown in Table 1 are dissolved in an equal quantity by weight of dibutyl phthalate and three times the quantity by weight of ethyl acetate in the presence of 0.15 g of sulpho succinic acid dioctyl ester at a temperature of 50° to 75° C. The solution is then stirred into 150 g of 7.5% by weight aqueous gelatine solution heated to about 40° C.

(b) Preparation of the colour photographic recording materials to be tested.

The dispersion prepared under (a) is mixed with a silver halide emulsion containing 8.2 g of silver in the form of silver bromide, 9.2 g of gelatine and 0.04 g of sodium dodecyl benzene sulphonate. The total volume is made up to 350 ml with water. The resulting casting solution is cast on a layer support of cellulose triacetate.

(c) Hardening and drying.

A hardening layer of 400 mg of gelatine and 400 mg of instant hardener (CAS Reg. No. 65 411-60-1) is poured over the cast layer. The combination of layers is dried at 50° to 60° C.

(d) Processing and assessment.

| Development Procedure<br>Bath | (Temperature 38° C.)<br>Min. |
|---|---|
| Colour development | 3.25 |
| Bleaching bath | 6.5 |
| Washing | 3 |
| Fixing bath | 6.5 |
| Washing | 6 |

1. Developer
(1 liter of reaction mixture)

| | |
|---|---|
| 800 ml | Distilled water |
| 4.5 g | 4-(N—ethyl-N—β-hydroxyethylamino)-2-methylaniline sulphate |
| 2.5 g | Hydroxylammonium sulphate |
| 4.0 g | Sodium sulphite |
| 1.5 g | Sodium bicarbonate |
| 33.5 g | Potassium carbonate |
| 1.35 g | Potassium bromide |
| | made up to 1 liter with distilled water |
| | pH: 10.0 |

2. Bleaching Bath
(1 liter of reaction mixture)

| | |
|---|---|
| 800 ml | Water |
| 139 g | Ammonium bromide |
| 86 g | Ethylenediaminotetra-acetic acid ammonium |
| 16 g | Ethylenediaminotetra-acetic acid |
| 10 g | Ammonia |
| | made up to 1 liter with water and adjusted to pH 6.0 with about 15 ml of glacial acetic acid. |

3. Fixing Bath
(1 liter of reaction mixture)

| | |
|---|---|
| 800 ml | Water |
| 150 g | Ammonium thiosulphate |
| 10 g | Sodium sulphite |
| 2 g | Sodium sulphite |
| 2 g | Sodium hexametaphosphate |
| | made up with water to 1 liter |
| | pH: about 7.5 |

Table 1 shows the colour yield FA, the sensitivity E and the gradation γ for numerous samples of material.

Table 1 shows that the coupling activity of the 4-equivalent magenta couplers (I) is substantially increased by the addition of thiosulphonic acid esters (II). The increased colour yield enables a smaller quantity of 4-equivalent magenta coupler to be applied in photographic materials and therefore also a correspondingly smaller quantity of silver halide.

TABLE 1

| Sample | I | II | FA | E | γ |
|---|---|---|---|---|---|
| 1 | I-1 | | 2,35 | 19,2 | 1,05 |
| 2 | I-14 | | 2,16 | 19,8 | 0,98 |
| 3 | I-16 | | 2,48 | 18,8 | 1,10 |
| 4 | I-8 | | 2,33 | 18,6 | 1,03 |
| 5 | I-1 | II-7 | 2,83 | 18,4 | 2,20 |
| 6 | I-14 | II-7 | 2,47 | 19,0 | 1,95 |
| 7 | I-16 | II-7 | 2,68 | 18,0 | 2,10 |
| 8 | I-8 | II-7 | 2,55 | 18,3 | 1,95 |
| 9 | I-1 | II-9 | 2,75 | 18,9 | 1,92 |
| 10 | I-14 | II-9 | 2,54 | 19,0 | 1,82 |
| 11 | I-16 | II-9 | 2,62 | 18,8 | 1,84 |
| 12 | I-1 | II-33 | 2,67 | 19,0 | 1,86 |
| 13 | I-16 | II-33 | 2,56 | 19,2 | 1,78 |
| 14 | I-1 | II-5 | 2,85 | 18,2 | 2,10 |
| 15 | I-16 | II-5 | 2,74 | 18,6 | 2,04 |
| 16 | I-8 | II-5 | 2,72 | 18,7 | 1,96 |
| 17 | I-1 | II-1 | 2,80 | 18,4 | 2,22 |
| 18 | I-16 | II-1 | 2,78 | 18,6 | 2,08 |

EXAMPLE 2

Dispersions of colour couplers are prepared similarly to Example 1 and a silver chloride emulsion is added so that casting solutions containing 20 g of magenta coupler, 12.5 g of silver and 54 g of gelatine are obtained. These casting solutions are applied in a similar manner to paper coated with polyethylene on both sides to result in a silver application (Ag) of about 0.3 g/m$^2$.

The layers are hardened and dried as in Example 1.

Samples of the layers are exposed through a step wedge and processed as described below.

Development 2

| | | |
|---|---|---|
| (a) | Colour Developer - 45 s - 35° C. | |
| | Triethanolamine | 9.0 g |
| | N,N'—diethyl-hydroxylamine | 6.0 g |
| | Diethylene glycol | 0.05 g |
| | 3-methyl-4-amino-N—ethyl-N—methane-sulphonamidoethyl-aniline sulphate | 6.0 g |
| | Potassium sulphite | 0.2 g |
| | Triethylene glycol | 0.05 g |
| | Potassium carbonate | 22 g |
| | Potassium hydroxide | 0.4 g |
| | Ethylenediaminotetra-acetic acid disodium salt | 2.2 g |
| | made up with water to 1,000 ml; pH 9.2. | |
| (b) | Bleach fixing bath - 45 s - 33° C. | |
| | Ammoniumthiosulphate | 75 g |
| | Sodium hydrogen sulphite | 13.5 g |
| | Ammonium acetate | 2.0 g |
| | Ethylenediaminotetra-acetic acid (iron-ammonium salt) | 57 g |
| | Ammonia, 25% | 9.5 g |
| | Acetic acid | 9.0 g |
| (c) | Washing - 2 min - 33° C. | |

Table 2 shows the gradation $\gamma_2$ and maximum colour density $D_{max}$ of numerous samples of material prepared as described above, including both the freshly processed material and the material measured after 10 days storage.

$\gamma_2$ is the gradation in the upper part of the colour density curve and is determined as the gradient of the straight line which intersects the colour density curve at points B and C, where A is the point on the curve which is situated at 0.1 density units above fog, B is the point on the curve corresponding to an exposure which is greater by 0.8 log I.t units than A while C is the point on the curve corresponding to an exposure which is greater by 0.8 log I.t units than B.

The maximum colour density $D_{max}$ of the fresh processed material is also given (in brackets) as a percentage, based on the corresponding value $D_{max}$ of the same sample after 10 day storage.

It will be seen from Table 2 that when mixtures according to the invention of 4-equivalent magenta couplers with thiosulphonic acid esters are used, the measurements show advantageous sensitometric results immediately after processing, both when compared to the results obtained with the 4-equivalent magenta coupler alone and when compared with the corresponding 2-equivalent magenta coupler alone. After 10 days storage, thee is virtually no change in the sensitometric values either in the samples according to the invention or in the comparison samples which contain 4-equivalent magenta coupler alone whereas in comparison samples containing 2-equivalent magenta coupler alone the sensitometric values rise sharply within 10 days until the level of the sensitometric values of the samples according to the invention is reached.

It is clear from these results that under the given conditions of rapid processing, the recording material according to the invention does not suffer the disadvantage of delayed dye formation which is normally observed when 2-equivalent magenta couplers are used.

The following 2-equivalent magenta couplers were used as comparison couplers:

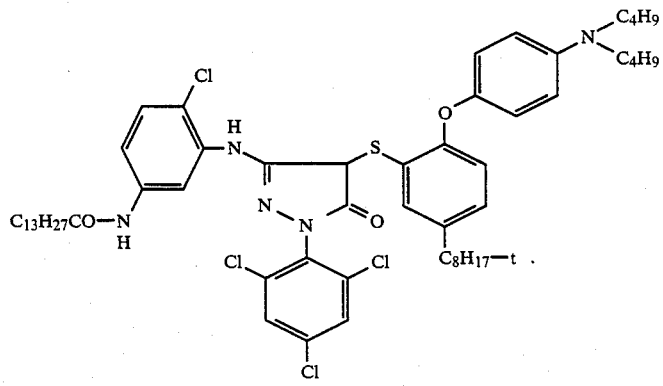

V-1

-continued

V-2

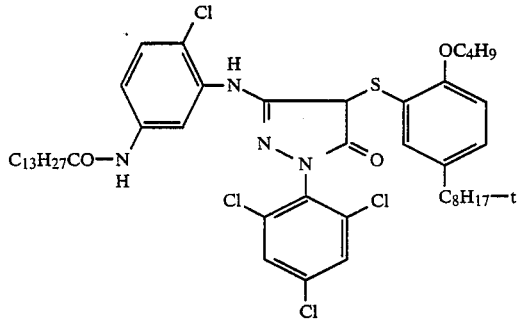

V-3

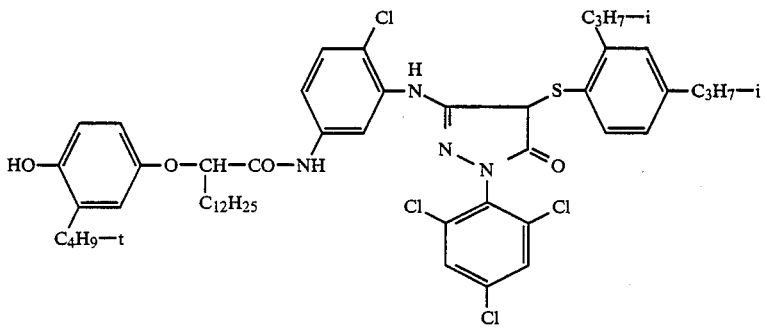

V-4

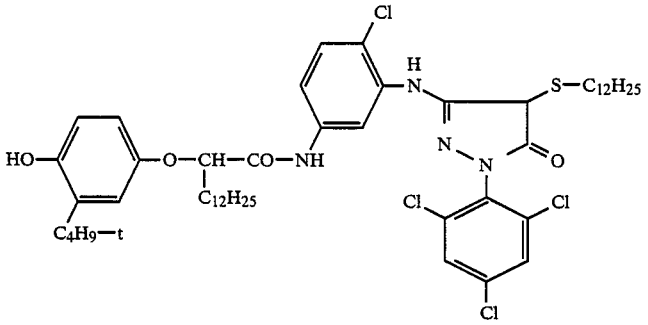

TABLE 2

| Sample | The following layers were prepared: I | II | $\gamma_2$ | $D_{max}$ Fresh | (%) | $\gamma_2$ | $D_{max}$ 10 days |
|---|---|---|---|---|---|---|---|
| 31 | I-1 | | 2.40 | 2.38 | (100) | 2.41 | 2.38 |
| 32 | 1-16 | | 2.52 | 2.62 | (100) | 2.50 | 2.62 |
| 33 | V-1 | | 1.41 | <1.0 | (<37) | 2.20 | 2.69 |
| 34 | V-2 | | 2.08 | 1.56 | ( 38) | 2.83 | 4.12 |
| 35 | V-3 | | 2.42 | 2.96 | ( 69) | 2.78 | 4.32 |
| 36 | V-4 | | 2.48 | 3.05 | ( 67) | 2.80 | 4.54 |
| 37 | I-1 | 11-24 | 2.44 | 2.32 | ( 81) | 2.74 | 2.86 |
| 38 | I-1 | 11-8 | 2.64 | 2.96 | ( 73) | 2.82 | 4.04 |
| 39 | I-16 | 11-7 | 2.62 | 4.12 | ( 96) | 2.78 | 4.30 |
| 40 | I-16 | 11-12 | 2.72 | 4.32 | ( 98) | 2.75 | 4.40 |
| 41 | I-1 | 11-1 | 2.82 | 4.64 | ( 99) | 2.84 | 4.68 |
| 42 | I- | 11-20 | 2.72 | 4.32 | ( 99) | 2.72 | 4.36 |

EXAMPLE 3

A layer support of paper coated with polyethylene on both sides was covered with the layers described below. The quantities are based on 1 $m^2$.

1. A substrate layer of 200 mg of gelatine with the addition of $KNO_3$ and chrome alum.

2. A blue sensitive silver chloride emulsion layer of 600 mg of $AgNO_3$ containing 2,100 mg of gelatine, 1.1 mmol of yellow coupler, 27.7 mg of 2,5-dioctylhydroquinone and 1,200 mg of tricresyl phosphate.

3. An interlayer of 1,300 mg of gelatine, 80 mg of 2,5-dioctyl-hydroquinone and 100 mg of tricresyl phosphate.

4. A green sensitive silver chloride emulsion layer of 530 mg of $AgNO_3$ containing 750 mg of gelatine, 0.625 mmol of a magenta coupler shown in Table 3 below, 118 mg of α-(3-t-butyl-4-hydroxyphenoxy)-myristic acid ethyl ester, 43 mg of 2,5-dioctylhydroquinone and oil former as shown in Table 3 below.

5. An interlayer of 1,550 mg of gelatine, 285 mg of UV absorbent Tinuvin 343®, 80 mg of dioctylhydroquinone and 650 mg of tricresyl phosphate.

6. A red sensitive silver chloride emulsion layer of 400 mg of $AgNO_3$ containing 1,470 mg of gelatine, 0.780 mmol of cyan coupler, 285 mg of dibutyl phthalate and 122 mg of tricresyl phosphate.

7. A protective layer of 1,200 mg of gelatine and 134 mg of Tinuvin 343®.

8. A hardening layer of 400 mg of gelatine and 400 mg of an instant, hardener (CAS Reg. No. 65411-60-1).

The following couplers were used in layers 2 and 6:

Yellow coupler

-continued

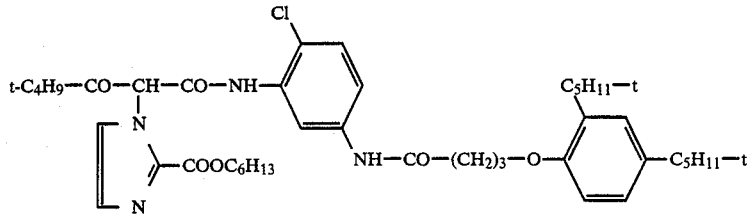

Cyan coupler

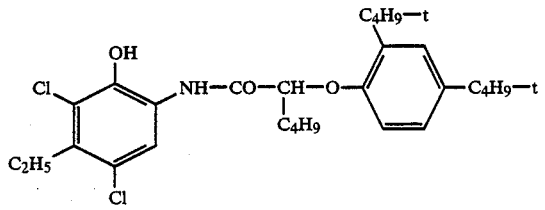

The quantities of coupler and silver halide in layer 4 are applicable when the magenta coupler is a 4-equivalent coupler without the addition of thiosulphonic acid ester. When a thiosulphonic acid ester is added or when a 2-equivalent magenta coupler is used, the quantity of coupler applied is 0.5 mmol and the quantity of silver chloride is 450 mg $AgNO_3$.

Various recording materials differing only in layer 4 were prepared, as shown in the following Table 3:

The following 2-equivalent magenta coupler was used as comparison compound V-5:

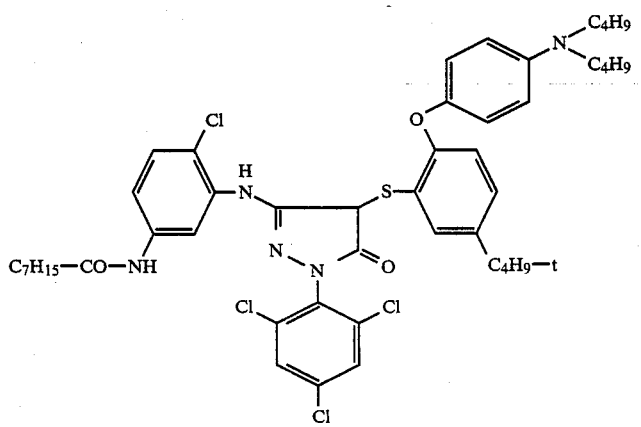

TABLE 3

| Sample | (Layer 4) I | II |
|---|---|---|
| 61 | 1-1 | — |
| 62 | 1-16 | — |
| 63 | V-1 | — |
| 64 | V-3 | — |
| 65 | V-5 | — |
| 66 | I-1 | II-24 |
| 67 | I-1 | II-9 |
| 68 | I-1 | II-7 |
| 69 | I-16 | II-7 |
| 70 | I-16 | II-12 |

The samples were all exposed to the same amount of white light behind a grey step wedge and processed by the short time process described in Example 2. The resulting samples were assessed visually and examined densitometrically while still fresh. Light stability tests were also carried out with a Xenon lamp.

The following photographic results were obtained:

(A) Comparison samples 61 and 62 containing a large quantity of coupler and silver were neutral and the magenta dyes were comparable in their stability but the residual couplers left in the samples yellowed in storage, more so in sample 61 than in sample 62 (poor image white).

(B) Comparison samples 63 to 65 containing only small quantities of coupler and silver had a strong tinge of discolouration after development and the material tipped from neutral grey at low density to greenish grey at a high density. Densitometric measurements showed that the colour density of the magenta dye passed through a maximum. The stability of the magenta dye to light was good and the residual couplers yellowed only slightly.

(C) Samples 66 to 70 according to the invention with a low application of coupler and silver were neutral grey after development. The stability to light of the magenta dye was good and the tendency to yellowing was slight.

Better photographic test results, with the advantage of requiring smaller quantities compared with 4-equivalent magenta couplers and the advantage of easier accessability and less cost of chemical preparation compared with 2-equivalent magenta couplers (loss on synthesis from 30 to 50%) impressively show the advantages of using 4-equivalent magenta couplers in combination with thiosulphonic acid esters in photographic layers.

I claim:

1. Photographic recording material having at least one light sensitive silver halide emulsion layer with which a magenta coupler of the pyrazolone series is associated, characterised in that the layer containing the magenta coupler was prepared by casting a solution containing a 4-equivalent magenta coupler corresponding to the following formula I

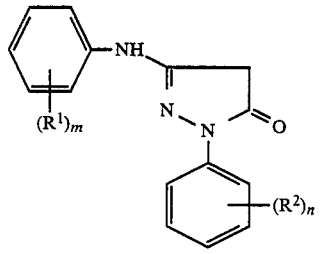

I wherein n denotes 1 to 5, m denotes 1 to 3, $R^1$ denotes halogen, alkoxy, alkylthio, acylamino, carbamoyl, sulphonamido, sulphamoyl or alkoxycarbonyl and $R^2$ denotes halogen, cyhano, thiocyanato, alkoxy, alkyl, acylamino, carbamoyl, sulphonylamido, sulphamoyl or alkoxycarbonyl, and a thiosulphonic acid ester compound.

2. Recording material as claimed in claim 1, wherein the thiosulphonic acid ester compound corresponds to the following general formula II:

$$R^3—SO_2—S—R^4$$

wherein $R^3$ and $R^4$ denote, independently of one another, alkyl, aralkyl, aryl or a heterocyclic group.

3. Recording material as claimed in claim 1 wherein 4-equivalent magenta couplers and thiosulphonic acid esters are used in a molar ratio of from 0.25:1 to 2.0:1.

4. Recording material as claimed in claim 3 wherein the couplers and the thiosulphonic acid esters are used in a molar ratio of from 0.7:1 to 1.2:1.

5. Recording material as claimed in claim 2 wherein $R^3$ contains at least 16 carbon atoms.

* * * * *